United States Patent [19]

Abe

[11] Patent Number: 4,928,649

[45] Date of Patent: May 29, 1990

[54] IGNITION TIMING CONTROL SYSTEM FOR AN AUTOMOTIVE ENGINE

[75] Inventor: Kunihiro Abe, Higashimurayama, Japan

[73] Assignee: Fuji Jukogyo Kabushiki Kaisha, Tokyo, Japan

[21] Appl. No.: 358,164

[22] Filed: May 26, 1989

[30] Foreign Application Priority Data

May 31, 1988 [JP] Japan ..... 63-133828

[51] Int. Cl.[5] ..... F02P 5/15

[52] U.S. Cl. ..... 123/414; 123/417

[58] Field of Search ..... 123/414, 416, 417, 418, 123/612, 613, 617; 73/117.3

[56] References Cited

U.S. PATENT DOCUMENTS

| | | | |
|---|---|---|---|
| 4,267,810 | 5/1981 | Wesemeyer et al. | 123/414 X |
| 4,355,613 | 10/1982 | Rode et al. | 123/414 |
| 4,426,974 | 1/1984 | Nash | 123/417 X |
| 4,499,544 | 2/1985 | Ohba et al. | 123/417 X |
| 4,726,338 | 2/1988 | Decker et al. | 123/414 |
| 4,760,827 | 8/1988 | Schreiber et al. | 123/414 |
| 4,797,827 | 1/1989 | Cockerham | 123/414 X |

FOREIGN PATENT DOCUMENTS

| | | | |
|---|---|---|---|
| 60-85256 | 5/1985 | Japan . | |
| 2209191 | 5/1989 | United Kingdom | 123/414 |

*Primary Examiner*—Willis R. Wolfe

*Attorney, Agent, or Firm*—Martin A. Farber

[57] ABSTRACT

A disk is secured to a crankshaft of an engine, and two projections are provided on a periphery of the disk. A sensor is provided for sensing the projections. An angle between two projections is stored in a memory in a form of $K \cdot 2^n$, where K is resolution of the system and n is a natural member. Time interval between the projections is calculated as a binary number. The time interval is shifted by n times, thereby producing a quotient signal representing the quotient of division of the time interval by the angle. An ignition timing is calculated based on the quotient signal.

4 Claims, 4 Drawing Sheets

IGNITION TIMING CONTROL SYSTEM FOR AN AUTOMOTIVE ENGINE

BACKGROUND OF THE INVENTION

The present invention relates to an ignition timing control system for an automotive engine with a time control system.

Japanese Patent Application Laid-Open No. 60-85256 discloses an ignition timing control system with a time control system.

In the ignition timing control system, a rotor disk is provided for rotating in synchronism with a crankshaft of the engine, and position indicator means, such as projections on the periphery of the disk, are provided at every position corresponding to predetermined crank angles. A sensor is mounted adjacent the rotor disk for producing a crank angle signal at the position of the indicator means in the form of a pulse. The pulse signal is applied to an electronic control unit comprising a microcomputer. The control unit detects the pulse spacing time T and pulse spacing crank angle $\theta$. On the other hand, an ignition angle $\theta_{SPK}$ is derived from a map in accordance with engine speed and engine load. An ignition timing $T_{SPK}$ is calculated as follows.

$$T_{SPK}=T/\theta\times\theta_{SPK}$$

However, the microcomputer takes time to perform the division in the above equation.

Consequently, the time for calculating the ignition timing is reduced by the time for the division. Therefore, the ignition timing can not be properly controlled. In order to overcome this defect, a microcomputer having a large capacity must be used, which increases a manufacturing cost.

SUMMARY OF THE INVENTION

The object of the present invention is to provide an ignition timing control system in which the ignition timing is calculated with accuracy and properly controlled in a high engine speed range.

According to the present invention, there is provided a system for controlling ignition timing of an internal combustion engine, having a rotary member provided to be rotated in synchronism with a crankshaft of the engine, at least two indicator means formed on the rotary member, and a sensor for sensing said indicator means and for producing signals.

The system comprises a memory storing an angle between the two indicator means in a form of $K\cdot 2^n$, where K is resolution of the system and n is a natural number, first calculator means for calculating time interval between the indicator means and for producing a time interval signal in binary, shifting means for shifting the time interval signal by n times and for producing a quotient signal representing the quotient of the division of the time interval by the angle, second calculator means for calculating an ignition timing based on the quotient signal and for producing an ignition signal, and an ignition device responsive to the ignition signal for sparking a spark plug of the engine.

In an aspect of the invention, the second calculator means calculates the ignition timing by multiplying the quotient by an ignition angle. Preferably the rotary member is a disk secured to a camshaft of the engine, and the indicator means are projections formed on a periphery of the disk.

The other objects and features of this invention will become understood from the following description with reference to the accompanying drawings.

DETAILED DESCRIPTION OF THE PREFERRED EMBODIMENTS

Figure 1:
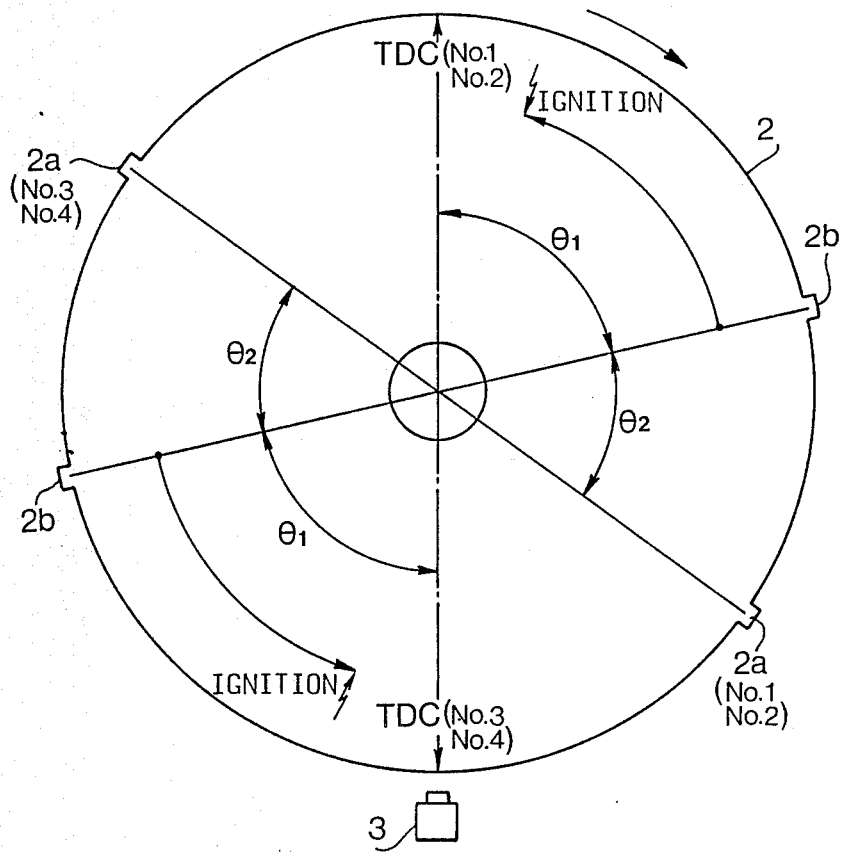
FIG. 1 shows a crankshaft disk provided in a system according to the present invention.

Referring to FIG. 1, a crankshaft 1 of a four-cylinder engine for a motor vehicle has a crankshaft disk 2 secured thereto. Cylinders of the engine are divided into two groups. The first group consists of No. 1 and No. 3 cylinders, and the second group consists of No. 2 and No. 4 cylinders, in each group, top dead centers for both cylinders have the same timing. A crank angle sensor 3 (magnetic pickup) is provided adjacent the crankshaft disk 2. The crankshaft disk 2 has a pair of first projections 2*a* and a pair of second projections 2*b*. The first projections 2*a* are diametrically opposite to each other and the second projections 2*b* are also diametrically opposite to each other.

An angle $\theta_1$ of each of the projections 2*b* is, for example, 83° before the top dead center (BTDC). An angle $\theta_2$ between projections 2*a* and 2*b*, which is a pulse spacing angle, is set in a form of $K\cdot 2^n$. K is a resolution of a microcomputer in an electronic control unit of the system. The resolution is normally 1 bit so that K is 1. The power n is a natural number (n=1, 2, 3, 4, 5 . . . ). Namely, the angle $\theta_2$ is set to $$\theta_2=K\cdot 2^n=2°, 4°, 8°, 16°, 32°, 64°, \ldots$$

In FIG. 1, the angle $\theta_2$ is set to 32° (n=5).

When the crankshaft disk 2 rotates, the crank angle sensor 3 detects positions of projections 2*a* and 2*b* and produces signals in the form of pulses.

Figure 2:
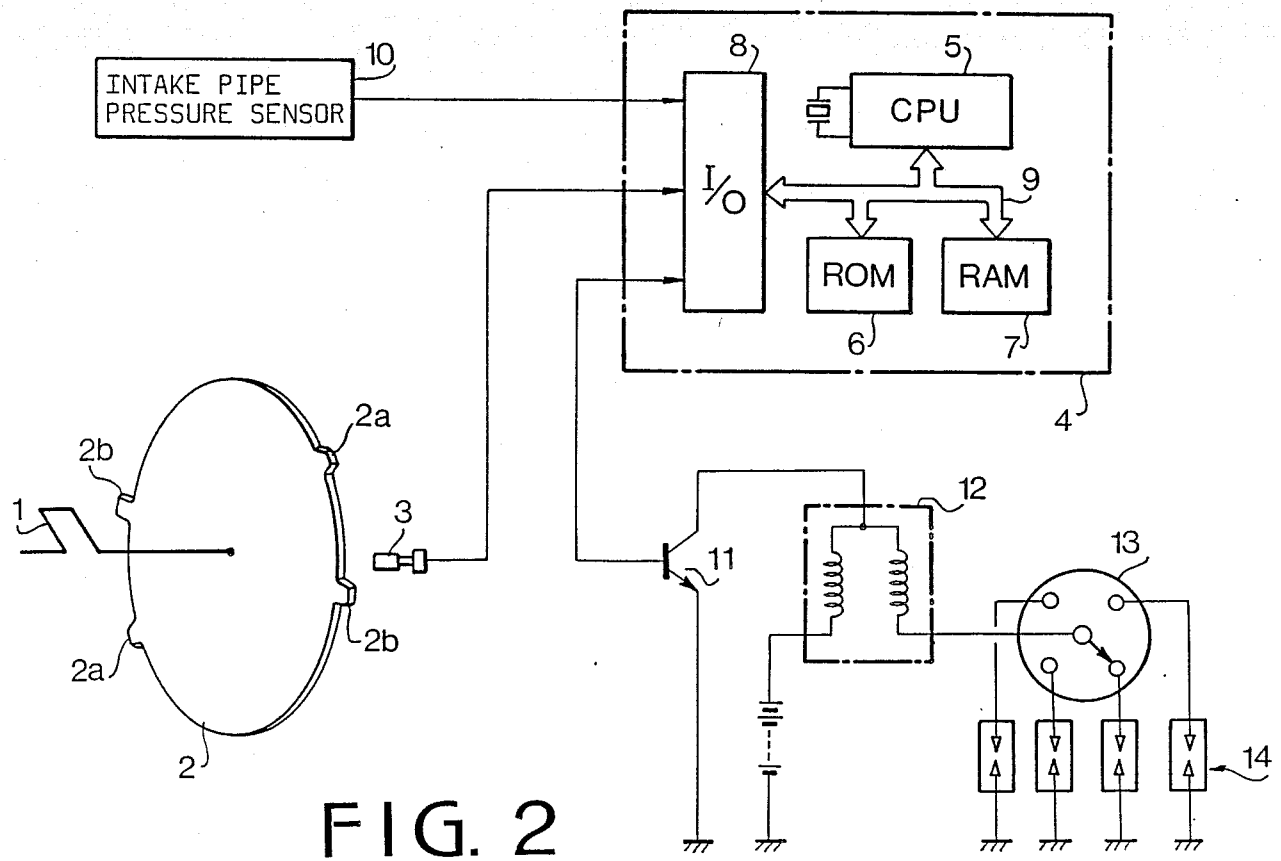
FIG. 2 is a schematic illustration of the system.

Referring to FIG. 2, an electronic control unit 4 comprising a microcomputer has a CPU 5, a ROM 6, a RAM 7, and an input/output interface 8, which are connected to each other through a bus line 9.

The crank angle sensor 3 and an intake pipe pressure sensor 10 are connected to an input port of the input/output interface 8. An output port of the interface 8 is connected to a base of a power transistor 11 as a driver. A collector of the transistor 11 is connected to a primary winding of an ignition coil 12 and a secondary winding thereof is connected to a spark plug 14 of a corresponding cylinder through a distributor 13.

Control programs and fixed data of an ignition timing map are stored in the ROM 6. Output signals of the sensors 3 and 10 are stored in the RAM 7. The CPU 5 calculates the ignition timing in accordance with a control program in the ROM 6 and based on various data in the RAM 7.

Figure 3:
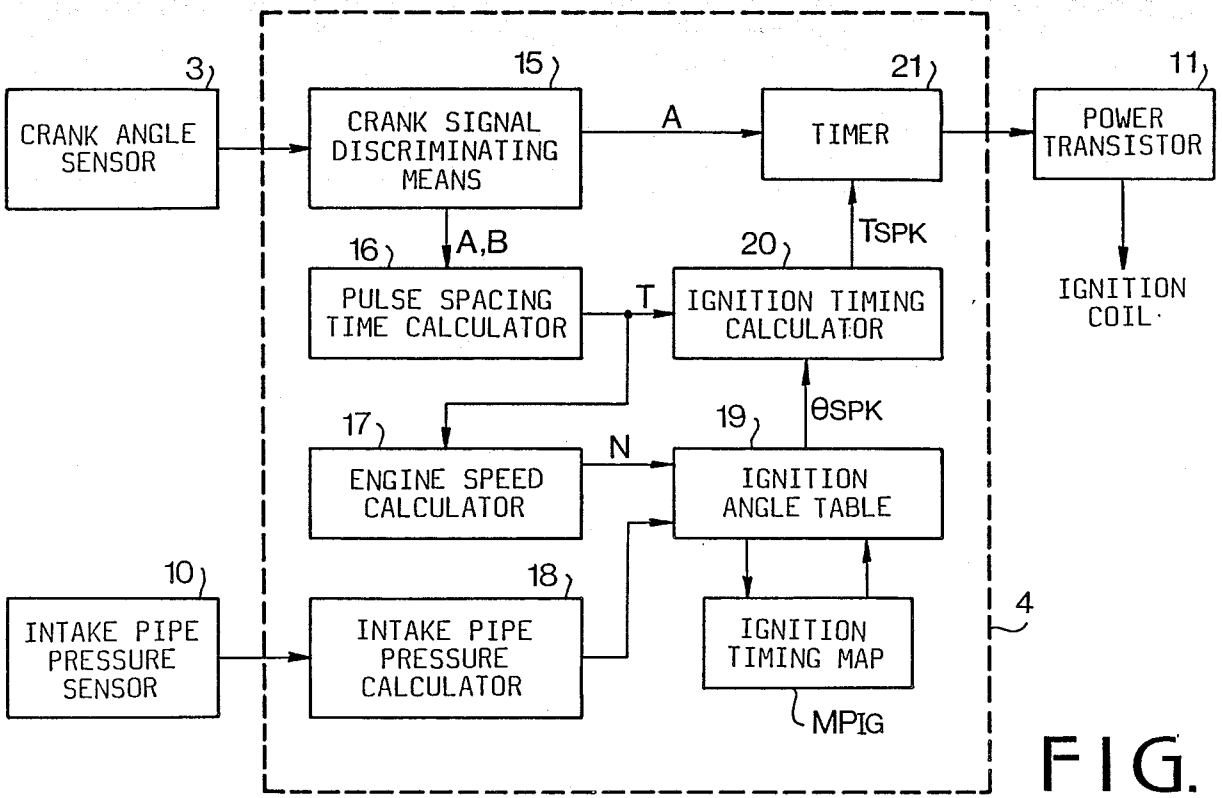
FIG. 3 is a block diagram of an electronic control unit.

Referring to FIG. 3, the control unit 4 comprises a crank angle signal discriminating means 15 applied with the crank signal from the crank angle sensor 3. The crank angle signal discriminating means 15 discriminates a reference crank angle signal A dependent on projection 2a from an angle signal B dependent on projection 2b. Namely, on the basis of a first crank angle signal applied from the sensor 3, an interval T1 between the first crank angle signal and a second crank angle signal is measured. Then, on the basis of the second crank angle signal, an interval T2 between the second crank angle signal and a third crank angle signal generated after the second crank angle signal is measured. The interval T1 is compared with the interval T2. When $T_2<T_1$, it is determined that the third crank angle signal produced after the second crank angle signal is the signal B. When $T_2<T_1$, it is determined that the third crank angle signal is the signal A. When the crank angle signal A is discriminated, the crank angle signal discriminating means 15 produces a trigger signal which is applied to a timer 21. These signals A and B are applied to a pulse spacing time calculator 16 where a pulse spacing time T is obtained in accordance with a time interval between signals A and B.

The pulse spacing time T is obtained by a counter as binary number data and stored in RAM 7. As described above, in the conventional system, the time T is divided by an angle $\theta$. In the present invention, such a division is not performed as described hereinafter.

Figure 5:
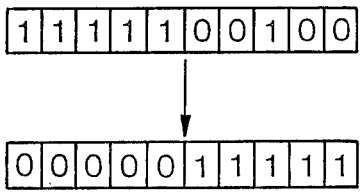
FIG. 5 shows binary numbers.

If the time T is 1000 $\mu$sec, the time T is represented as 1111100100 in binary. The binary number 1111100100 is stored in a predetermined address of the RAM 7. As described hereinbefore, when the pulse spacing angle $\theta_2$ is 32°, n is 5. A demand signal for shifting the binary number by 5 times to the right is applied to an ignition timing calculator 20 in accordance with the control program stored in the ROM 6. When the binary number 1111100100 is shifted to the right by 5, the binary number becomes 11111 as shown in FIG. 5. The decimal number equivalent of 11111 is 31. This means that the division 1000/32=31 is performed. The calculator 20 produces a quotient (31) signal Q.

On the other hand, the pulse spacing time T is applied to an engine speed calculator 17 for calculating an engine speed N.

An intake pipe pressure signal from the intake pipe pressure sensor 10 is applied to an intake pressure calculator 18 where an engine load L is calculated. The engine speed N and the engine load L are applied to an ignition angle table 19. In the table 19, a corresponding address of an ignition timing map $MP_{IG}$ is selected in accordance with these signals N and L, and an ignition angle $\theta_{SPK}$ is read from the address. The ignition angle $\theta_{SPK}$ is applied to the ignition timing calculator 20. An ignition timing $T_{SPK}$ is calculated as follows.

$$T_{SPK}=\theta_{SPK}\times Q$$

The ignition timing $T_{SPK}$ is set in the timer 21 which starts measuring time in accordance with the angle signal B representing 83° BTDC. When the timer reaches a set ignition timing $T_{SPK}$, a spark signal is applied to the power transistor 11.

Figure 4:
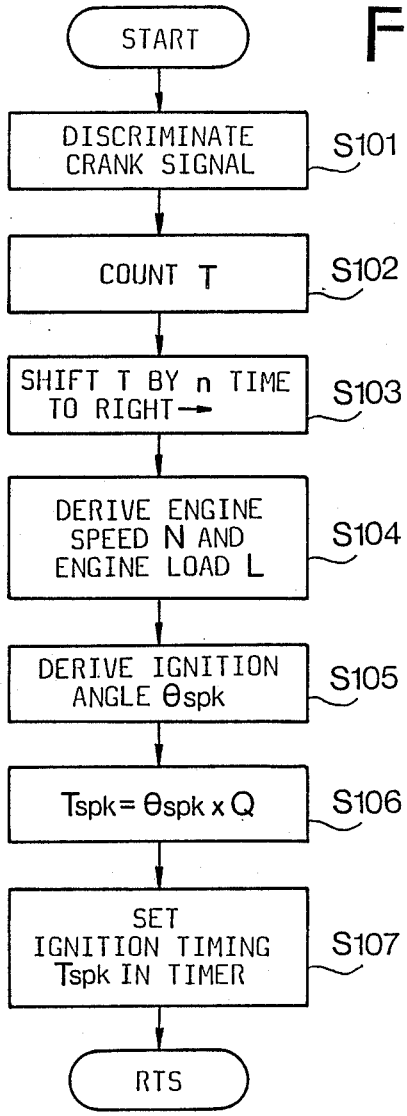
FIG. 4 is a flowchart showing the operation of the system.

Explaining the operations of the system with reference to a flowchart of FIG. 4, at a step S101, it is determined whether a pulse signal from the crank angle sensor 3 is the crank angle signal A dependent on projection 2a or the angle signal B dependent on projection 2b.

At a step S102, the pulse spacing time T between the signals A and B is counted. At a step S103, the time T obtained as a binary number is shifted by n times to the right, so that the quotient signal Q is produced. Thus, in accordance with the present invention, processing time can be remarkably reduced.

At a step S104, the engine speed N and the engine load L are read out. At a step S105, the ignition angle $\theta_{SPK}$ is derived from the ignition timing map $MP_{IG}$ in accordance with signals N and L. At a step S106, the ignition timing $T_{SPK}$ is calculated. At a step s107, the ignition timing $T_{SPK}$ is set in the timer 21 which starts measuring time with respect to the signal B. When the timer reaches set ignition timing $T_{SPK}$, a spark signal is applied to the ignition coil 12 to cut off the circuit for the primary winding of the coil 12. The spark plug 14 of the corresponding cylinder is sparked through the distributor 13.

In the present invention, although the projections 2a and 2b are formed on the crankshaft disk 2, the projections can be replaced with notches or slits. The engine load can be detected by other sensors such as an airflow meter or a throttle position sensor, or by a fuel injection pulse width. Further, in place of the crankshaft disk 2 secured to the crankshaft 1, a camshaft disk secured to a camshaft (not shown) is employed for detecting the crank angle.

In accordance with the present invention, the execution time for calculating the ignition timing is remarkably reduced. The ignition timing is accurately calculated without using a microcomputer having a large capacity and the ignition timing is properly controlled in a high engine speed range.

While the presently preferred embodiments of the present invention have been shown and described, it is to be understood that these disclosures are for the purpose of illustration and that various changes and modification may be made without departing from the scope of the invention as set forth in the appended claims.

What is claimed is:

1. A system for controlling ignition timing of an internal combustion engine, having a rotary member provided to be rotated in synchronism with a crankshaft of said engine, at least two indicator means formed on said rotary member, and a sensor for sensing said indicator means and for producing signals, comprising:

a memory storing an angle between said two indicator means in a form of $K\cdot 2^n$, where K is resolution of the system and n is a natural number;

first calculator means for calculating a time interval between said indicator means and for producing a time interval signal in binary;

shifting means for shifting the time interval signal by n times and for producing a quotient signal representing the quotient of division of the time interval by the said angle;

second calculator means for calculating an ignition timing based on the quotient signal and for producing an ignition signal; and an ignition device responsive to the ignition signal for sparking a spark plug of the engine.

2. The system according to claim 1, wherein the second calculator calculates the ignition timing by multiplying the quotient by an ignition angle.

3. The system according to claim 1, wherein said rotary member is a disk secured to a camshaft of said engine.

4. The system according to claim 2, wherein said indicator means are projections formed on a periphery of said disk.

* * * * *